US009267652B2

(12) United States Patent
Gielen

(10) Patent No.: US 9,267,652 B2
(45) Date of Patent: Feb. 23, 2016

(54) LIGHTING MODULE FOR A MODULAR LIGHTING SYSTEM

(75) Inventor: Herman Johannes Gertrudis Gielen, Roosendaal (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 113 days.

(21) Appl. No.: 14/129,374

(22) PCT Filed: Jun. 28, 2012

(86) PCT No.: PCT/IB2012/053284

§ 371 (c)(1),
(2), (4) Date: Dec. 26, 2013

(87) PCT Pub. No.: WO2013/005144

PCT Pub. Date: Jan. 10, 2013

(65) Prior Publication Data

US 2014/0111994 A1 Apr. 24, 2014

(30) Foreign Application Priority Data

Jul. 1, 2011 (EP) ..... 11172398

(51) Int. Cl.
*F21K 99/00* (2010.01)
*F21S 2/00* (2006.01)
*F21V 21/00* (2006.01)

(52) U.S. Cl.
CPC . *F21K 9/30* (2013.01); *F21S 2/005* (2013.01); *F21V 21/00* (2013.01)

(58) Field of Classification Search
CPC ..... F21V 21/00; F21S 2/005; F21K 9/30
USPC ..... 362/249.01, 249.02
See application file for complete search history.

(56) References Cited

U.S. PATENT DOCUMENTS

| | | | | |
|---|---|---|---|---|
| 8,593,043 | B2 * | 11/2013 | Igaki et al. | 313/110 |
| 2009/0225546 | A1 | 9/2009 | Pearson et al. | |
| 2009/0244885 | A1 * | 10/2009 | Watanabe et al. | 362/97.1 |
| 2010/0020267 | A1 | 1/2010 | Kobayashi | |
| 2010/0046227 | A1 * | 2/2010 | Knoble et al. | 362/249.06 |
| 2010/0123380 | A1 | 5/2010 | Lee | |
| 2011/0228530 | A1 * | 9/2011 | Roberts et al. | 362/235 |
| 2012/0188759 | A1 * | 7/2012 | Sato et al. | 362/230 |

FOREIGN PATENT DOCUMENTS

| | | | |
|---|---|---|---|
| EP | 2189707 | A2 | 5/2010 |
| JP | 2007048666 | A | 2/2007 |
| JP | J2009016093 | A | 7/2009 |

* cited by examiner

*Primary Examiner* — Anabel Ton
(74) *Attorney, Agent, or Firm* — Yuliya R. Mathis

(57) ABSTRACT

The present invention relates to a lighting module (20*a*, 20*b*, 20*c*), a modular lighting system (2) and a method of manufacturing such a lighting module. The lighting module comprises a board (21) having a central portion (24) and a peripheral edge (22) adapted to be coupled to the peripheral edge of the board of another lighting module, and a plurality of light sources (23) arranged at the board such that the pitch in proximity to the peripheral edge is larger than the pitch in proximity to the central portion. The present invention is advantageous in that it enables the realization of a modular lighting system whose luminance distribution is perceived as more homogenous. The pitch between the light sources of the board can be reduced while reducing the perception of any dark areas between neighboring lighting modules as illuminance interruptions (or discontinuities).

9 Claims, 2 Drawing Sheets

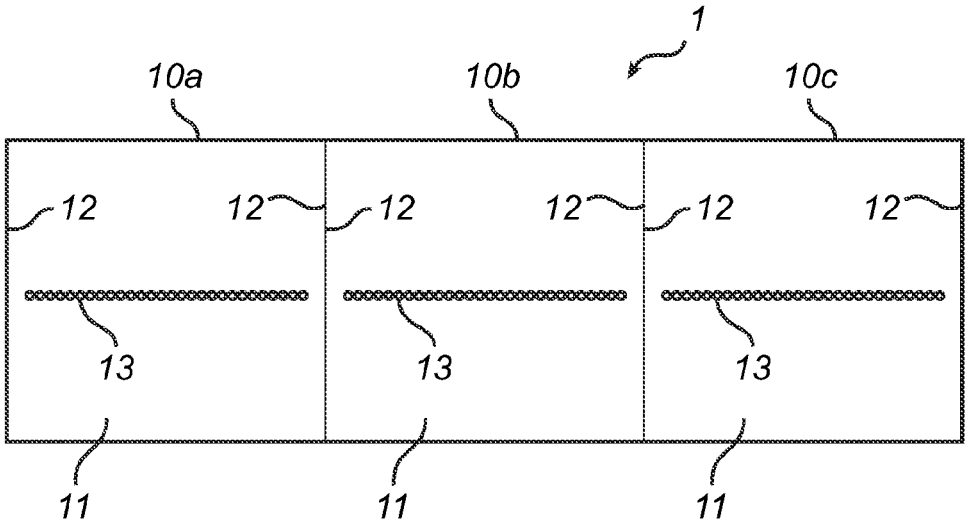
(Prior art) Fig. 1
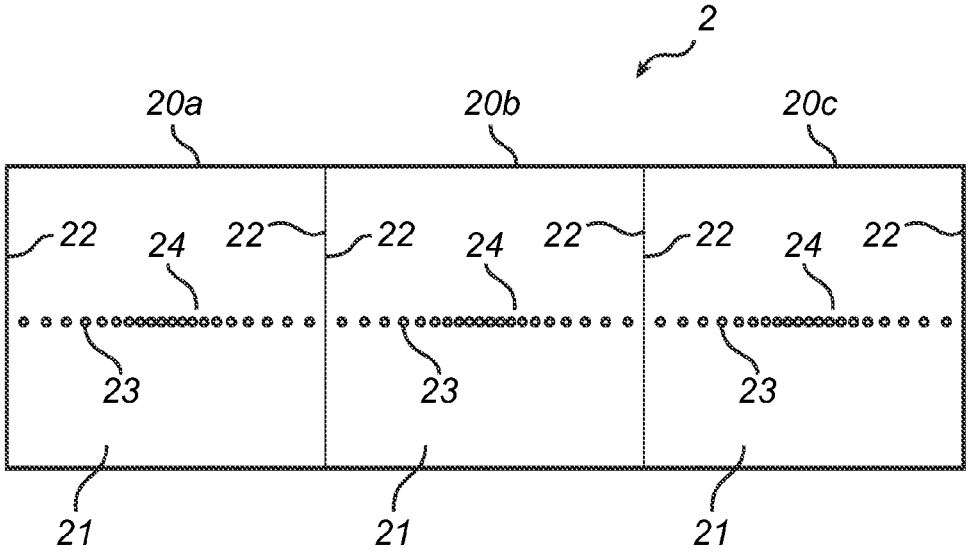
Fig. 2

LIGHTING MODULE FOR A MODULAR LIGHTING SYSTEM

FIELD OF THE INVENTION

The present invention generally relates to the field of modular lighting systems. In particular, the present invention provides a lighting module and a method of manufacturing a lighting module.

BACKGROUND OF THE INVENTION

Modular lighting systems can be used to provide customized lighting. The number of lighting modules and their assembly can be varied to provide a certain desired illumination. In such lighting modules, a matrix of light sources, such as light emitting diodes (LEDs), is arranged at a board with a certain pitch between the light sources. The pitch may be defined as the distance between the light sources from centre to centre. The smaller and more constant pitch the more continuous illumination is provided from the lighting module. With a smaller pitch, the light sources appear like a single light source (instead of several separate lighting points), when viewed at a shorter distance from the lighting module.

An example of a modular structure of an LED light source is disclosed in US2010/0123380. LEDs are arranged on a circuit board as regular hexagons, with an equal distance between every two adjacent LEDs, such that the modular structure of the LED light source provides uniform illumination.

SUMMARY OF THE INVENTION

An object of the present invention is to provide an improved alternative to the above mentioned technique and prior art. More specifically, it is an object of the present invention to provide a modular lighting system having a luminance distribution with improved homogeneity.

These and other objects of the present invention are achieved by means of a lighting module and a method of manufacturing a lighting module for a modular lighting system having the features defined in the independent claims. Preferable embodiments of the invention are characterized by the dependent claims.

Hence, according to a first aspect of the present invention, a lighting module for a modular lighting system is provided. The lighting module comprises a board having a central portion and a peripheral edge adapted to be coupled to the peripheral edge of the board of another lighting module, and a plurality of light sources arranged at the board such that the pitch in proximity to the peripheral edge is larger than the pitch in proximity to the central portion.

According to a second aspect of the present invention, a method of manufacturing a lighting module for a modular lighting system is provided. The method comprises the steps of providing a board having a central portion and a peripheral edge adapted to be coupled to a peripheral edge of a board of another lighting module in the modular lighting system, and arranging a plurality of light sources at the board such that the pitch in proximity to the peripheral edge is larger than the pitch in proximity to the central portion.

In the present application, with the term "pitch" it is meant the distance between the center of a light source to the center of a neighbouring light source (i.e. the next adjacent light source), i.e. the distance center-to-center between two neighbouring (adjacent) light sources.

Reducing the pitch between the light sources is desirable since the light sources are then not perceived as single lighting points, thereby providing a more continuous/homogeneous illumination. For example, the pitch may be as small as 5 mm, wherein the illumination is perceived as continuous already at a small distance from the lighting module. A way of evaluating uniformity of a lighting module is to measure the peak-peak ripple (which is the variation in luminance) at a surface of a diffuser placed in front of the lighting module. Approximating the light sources to point sources, with a pitch of 5 mm, the peak-peak ripple is less than 1% already when the diffuser is located at 7 mm from the light source. That is, the light emitted by the diffuser will be perceived as continuous if the diffuser is located at a distance of at least 7 mm in front of the light source. The larger pitch, the larger distance is required to obtain a continuous illumination.

The present invention is based on the insight that reducing the pitch between the light sources arranged on a board of a lighting module (i.e. providing a lighting module with a very small pitch) has the drawback that, when mounted in a modular lighting system (i.e. a plurality of lighting modules assembled closed to each other), a dark area is visible between two adjacent lighting modules since the distance between two neighbouring (adjacent) light sources arranged on two separate neighbouring (adjacent) boards is larger than the pitch on the board. This relatively large pitch between the boards is caused by a limitation of how close the light sources can be arranged to the peripheral edge due to demands on minimum creepage and clearance distances and manufacturing tolerances for the boards.

The present invention is based on the idea of having a small pitch (i.e. reducing the pitch on the board) while reducing the visual effect of such dark areas by providing a smooth pitch variation. Such improvement is obtained by arranging the light sources in proximity to the peripheral edge with a larger pitch (more sparsely) than the light sources in proximity to the central portion. Hence, a smooth transition is provided from the (inevitable) large pitch between the boards to the smaller pitch towards the central portions of the boards.

The lighting module of the present invention is advantageous in that it enables the realization of a modular lighting system whose luminance distribution is perceived as more homogenous. The pitch between the light sources of the board can be reduced while reducing the perception of any dark areas between neighbouring lighting modules as illuminance interruptions (or discontinuities). An almost seamless illumination is provided when the lighting modules are put together, and hence, the variation in illuminance gradient across the modular lighting system is smoothened. Accordingly, the modular lighting system will be perceived as a single continuous light source from a shorter viewing distance.

In an embodiment of the present invention, the light sources may be arranged at the board such that the pitch gradually increases in a direction from the central portion towards the peripheral edge. Hence, when mounted adjacent to another lighting module in a modular lighting system, the pitch distribution is further smoothened across the modular lighting system, whereby the illuminance distribution of the modular lighting system is perceived as more homogenous.

According to an embodiment of the present invention, the pitch between the light sources located near the peripheral edge of the board may match (and preferably being slightly smaller than) the pitch/distance between the light source located closest to the peripheral edge and the light source of the other lighting module located closest to the peripheral edge of the other lighting module (i.e. the pitch between neighbouring light sources on neighbouring boards). With the term "match" it is meant that the two pitches are substantially the same. In other words, the pitch between the light sources near the peripheral edge of the board may preferably be equal to or slightly smaller than two times the distance from the peripheral edge to the light source closest to the peripheral edge. Hence, the largest pitch of the modular lighting system may be determined by the smallest possible distance from the peripheral edge which the light sources can be mounted at with regard to creepage and clearance distances and manufacturing tolerances.

In an embodiment of the present invention, the light sources may be distributed at the board in accordance with a sinusoidal variation. Hence, the pitch may vary like a sinus function having its maximum (i.e. the largest pitch) at the boundary between the two lighting modules and its minimums (i.e. the smallest pitch) at the central portions of the boards, which further contributes to smoothen the variation in the pitch distribution across the modular lighting system, and thus, the appearance of a more homogenous illuminance distribution is obtained.

In embodiments of the present invention, the light sources may be arranged in a line extending from a peripheral edge towards an opposite peripheral edge of the board, whereby an almost seamless line appearance is obtained by the modular lighting system. Alternatively, the light sources may be spread over the board, (i.e. cover almost the entire board or arranged in a 2D-pattern) thereby providing an almost seamless lighting surface of the modular lighting system.

According to an embodiment of the present invention, the light sources may be LEDs, which is advantageous in that LEDs can be made small, whereby a smaller pitch can be obtained.

According to a third aspect of the present invention, a modular lighting system is provided. The modular lighting system includes at least two lighting modules, wherein each lighting module is defined in accordance with the first aspect of the invention.

Further objectives of, features of, and advantages with, the present invention will become apparent when studying the following detailed disclosure, the drawings and the appended claims. Those skilled in the art realize that different features of the present invention can be combined to create embodiments other than those described in the following. In particular, it will be appreciated that the various embodiments described for the modular lighting system are all combinable with the method as defined in accordance with the second aspect of the present invention.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, in which:

FIG. 1 shows a prior art modular lighting system;

FIG. 2 shows a modular lighting system according to an embodiment of the present invention.

Figure 3:
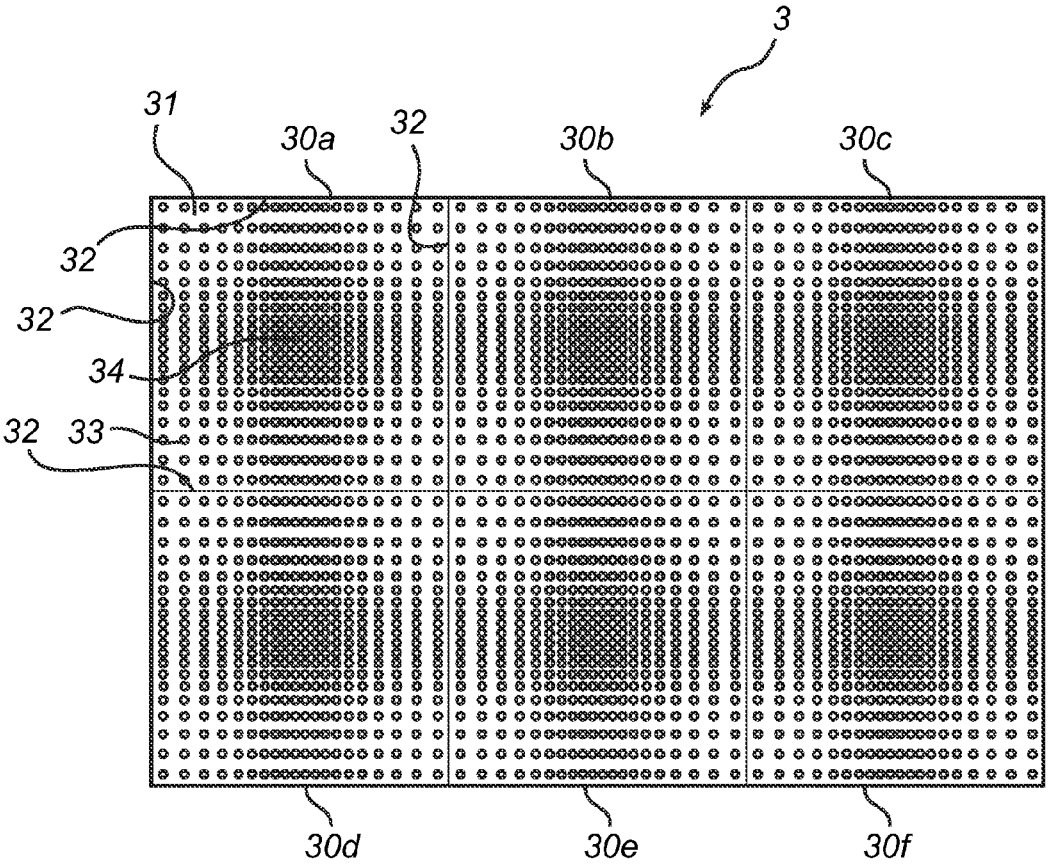
FIG. 3 shows another modular lighting system according to embodiment of the present invention.

All the figures are schematic, not necessarily to scale, and generally only show parts which are necessary in order to elucidate the invention, wherein other parts may be omitted or merely suggested.

DETAILED DESCRIPTION OF EMBODIMENTS

With reference to FIG. 1, a modular lighting system known in the art will be described. FIG. 1 shows a modular lighting system 1 comprising lighting modules 10*a*, 10*b* and 10*c*. Each lighting module 10*a*, 10*b* and 10*c* comprises a board 11 on which light sources 13 are arranged with a constant, small pitch (i.e. a constant, small distance between the light sources). Together, the light sources 13 of the lighting modules 10*a*, 10*b* and 10*c* form a line. Due to demands on minimum creepage and clearance distances and manufacturing tolerances, the light sources 13 have to be arranged at a predetermined minimum distance from the peripheral edges 12 of the boards 11. As illustrated in FIG. 1, this required minimum distance causes a discontinuity in the line formed by the light sources 13. Hence, a relatively large variation in illuminance gradient is obtained and dark areas (i.e. none-light emitting areas) will be visible between the lighting modules 10*a*, 10*b* and 10*c*.

Turning now to FIG. 2, an embodiment of the present invention will be described. FIG. 2 shows a modular lighting system 2 including lighting modules 20*a*, 20*b* and 20*c*. Each lighting module 20*a*, 20*b* and 20*c* comprises a board 21, e.g. including a printed circuit board (PCB), having a central (or middle) portion 24 and peripheral edges 22 adapted to be coupled to peripheral edges 22 of the other lighting modules 20*a*, 20*b* and 20*c*. Further, light sources 23, preferably LEDs, are arranged (or mounted) at each board 21. For example, the light sources 23 may be arranged in a line at each board 21 such that they together form a line across the modular lighting system 2 (as shown in FIG. 2). The light sources 23 are arranged at the boards 21 such that the pitch (between the light sources 23) is larger in proximity to the peripheral edges 22 than the pitch (between the light sources 23) in proximity to the central portions 24 of the boards 21. Preferably, the light sources 23 are arranged such that the pitch gradually increases towards the peripheral edges 22 and decreases towards the central portions 24. As illustrated in FIG. 2, the pitch may vary like a sinus function across the modular lighting system 2, wherein the maximum pitches are positioned between the boards 21 and the minimum pitches are positioned at the central portions 24 of the boards 21. As a result, gradual transitions are provided between the (inevitable) larger pitches between the boards 21 and the smaller pitches reducing the appearance of discontinuities in the illumination output from the modular lighting system 2.

As can be seen in a comparison, the variations in the pitch distribution of the modular lighting system 2 shown in FIG. 2 are smoother, and provides the appearance of a more homogenous illuminance distribution, than the variations in the pitch distribution of the prior art modular lighting system 1 shown in FIG. 1. The relatively large variation in illuminance gradient obtained in the modular lighting system 1 shown in FIG. 1 is more visible than the smoothened distribution obtained in the modular lighting system 2 shown in FIG. 2.

Another embodiment of the present invention will now be described with reference to FIG. 3. FIG. 3 shows a modular lighting system 3 including a plurality of lighting modules 30*a*-30*f*. Each lighting module 30*a*-30*f* comprises a board 31 having a central portion 34 and peripheral edges 32 adapted to be coupled to the peripheral edges 32 of other lighting modules in the modular lighting system 3. Light sources 33 are arranged such that they are spread at the board 31 and thereby (at least almost) covers the board 31. Further, the light sources 33 are arranged such that the pitch (between the light sources 33) is larger in proximity to the peripheral edges 32 than the pitch (between the light sources 33) in proximity to the central portions 34. In other words, the light sources 33 are more sparsely arranged towards the peripheral edges 32 than the light sources 33 towards the central portions 34. As a result, the lighting modules 30*a*-30*f* together form an almost seamless illumination surface with gradual transitions between the (inevitable) larger pitches between the boards 31 and the smaller pitches at the middle of the boards 31.

While specific embodiments have been described, the skilled person will understand that various modifications and alterations are conceivable within the scope as defined in the appended claims.

For example, the modular lighting system may include any number of lighting modules, and the lighting modules may be coupled together in any desired way (i.e. geometry).

Further, the light sources may be arranged at the board in any pattern having any shape, wherein the pitch is larger towards the peripheral edges than towards the central portion.

The invention claimed is:

1. A lighting module for a modular lighting system, the lighting module comprising:

a board having a central portion and a peripheral edge adapted to be coupled to the peripheral edge of the board of another lighting module; and a plurality of light sources arranged at the board such that the pitch in proximity to the peripheral edge is larger than the pitch in proximity to the central portion.

2. A lighting module as defined in claim 1, wherein the light sources are arranged at the board such that the pitch gradually increases in a direction from the central portion towards the peripheral edge.

3. A lighting module as defined in claim 2, wherein the pitch between light sources located near the peripheral edge of the board substantially matches the distance between the light source located closest to the peripheral edge and the light source of the other lighting module located closest to the peripheral edge of the other lighting module.

4. A lighting module as defined in claim 3, wherein the light sources are distributed at the board in accordance with a sinusoidal variation.

5. A lighting module as defined in claim 4, wherein the light sources are arranged in a line extending from a peripheral edge towards an opposite peripheral edge of the board.

6. A lighting module as defined in claim 5, wherein the light sources are spread over the board.

7. A lighting module as defined in claim 6, wherein the light sources are light emitting diodes.

8. A modular lighting system including at least two lighting modules, each lighting module being defined in accordance with claim 1.

9. A method of manufacturing a lighting module for a modular lighting system, the method comprising the steps of:

providing a board having a central portion and a peripheral edge adapted to be coupled to a peripheral edge of a board of another lighting module in the modular lighting system;

arranging a plurality of light sources at the board such that the pitch in proximity to the peripheral edge is larger than the pitch in proximity to the central portion.

* * * * *